US005146848A

United States Patent [19]

Dufour

[11] Patent Number: 5,146,848

[45] Date of Patent: Sep. 15, 1992

[54] APPARATUS FOR RECOVERING LIQUID FROM LIQUID-FILLED CONTAINERS

[76] Inventor: Henri Dufour, 1251 Grande Caroline, Rougemont, Quebec, Canada, G0L 1M0

[21] Appl. No.: 648,122

[22] Filed: Jan. 30, 1991

[51] Int. Cl.[5] ..... B30B 15/16; B30B 9/06

[52] U.S. Cl. ..... 100/53; 100/110; 100/112; 100/116; 100/127; 100/131; 100/244; 100/264; 134/166 R

[58] Field of Search ..... 100/53, 110, 112, 116, 100/126–129, 131, 215, 218, 244, 264; 134/166 R, 169 R

[56] References Cited

U.S. PATENT DOCUMENTS

| | | | |
|---|---|---|---|
| 250,979 | 12/1981 | Russell | 100/116 |
| 370,247 | 9/1987 | Cross | 100/127 |
| 825,957 | 7/1906 | Buckley | 100/110 X |
| 1,110,283 | 9/1914 | Beaston | 100/127 X |
| 1,231,929 | 7/1917 | Morlock | 100/127 X |
| 1,602,626 | 10/1926 | Power | 100/112 |
| 2,398,135 | 4/1946 | de la Roza, Sr. | 100/112 |
| 2,422,895 | 6/1947 | Habenicht | 100/127 X |
| 2,427,446 | 9/1947 | de la Roza, Sr. | 100/112 |
| 2,705,916 | 4/1955 | Millgard | 100/116 X |
| 2,851,776 | 9/1958 | Czulak et al. | 100/116 X |
| 3,070,003 | 12/1962 | Stacy | 100/244 X |
| 3,785,281 | 1/1974 | Ligh | 100/116 |
| 3,980,014 | 9/1976 | McEwen et al. | 100/127 |
| 4,214,519 | 7/1980 | Stollenwerk et al. | 100/127 X |
| 4,303,412 | 12/1981 | Baikoff | 100/244 X |
| 4,343,233 | 8/1982 | Burgin | 100/116 |
| 4,387,633 | 6/1983 | Ballantyne | 100/116 X |
| 4,440,073 | 4/1984 | Quilliou | 100/110 X |
| 4,467,715 | 8/1984 | Bunger | 100/116 X |
| 4,614,154 | 9/1986 | Simelunas et al. | 100/116 |
| 4,646,633 | 3/1987 | Falguieres | 100/127 X |
| 4,705,055 | 11/1987 | Rohm et al. | 100/112 X |

FOREIGN PATENT DOCUMENTS

| | | | |
|---|---|---|---|
| 2841015 | 4/1980 | Fed. Rep. of Germany | 100/127 |
| 44299 | 12/1927 | Norway | 100/116 |
| 388019 | 10/1973 | U.S.S.R. | 100/116 |
| 184225 | 8/1922 | United Kingdom | 100/110 |
| 1397133 | 6/1975 | United Kingdom | 100/116 |

*Primary Examiner*—Harvey C. Hornsby
*Assistant Examiner*—Stephen F. Gerrity
*Attorney, Agent, or Firm*—Swabey Ogilvy Renault

[57] ABSTRACT

An apparatus for recovering liquid from refuse liquid-filled containers comprises an elongated compression chamber formed by a cylindrical wall having a perforated cylindrical wall portion provided with a plurality of liquid collection orifices, an annular liquid collection chamber surrounding the perforated wall portion, a first plunger and a second plunger axially movable in the compression chamber relative to the first plunger. The first and second plungers have respective first and second perforated plates mounted in spaced relationship thereon and each provided with a plurality of liquid discharge orifices. When the second plunger is moved in a direction toward the first plunger to compress the refuse containers between the first and second perforated plates and thereby cause the containers to burst and expel liquid, the liquid is discharged through the liquid discharge orifices and the liquid collection orifices, and into the liquid collection chamber. Such an apparatus is particularly useful for recovering milk from refuse milk cartons or bags.

30 Claims, 8 Drawing Sheets

APPARATUS FOR RECOVERING LIQUID FROM LIQUID-FILLED CONTAINERS

BACKGROUND OF THE INVENTION

The present invention relates to the treatment and recycling of waste material, especially waste material having a high liquid content. More particularly, the invention is directed to an apparatus for recovering liquid from refuse liquid-filled containers.

In the food industry, millions of dollars are wasted annually by discarding refuse containers filled with liquid food products, such as milk, cream or fruit juice, due to overdating (i.e. the expiry date of the food product has passed), batching error (e.g. wrong percentage of fat in milk having a predetermined fat content) and/or error in the volume of content or container. Attempts have been made to puncture or shred refuse milk cartons with a view to recovering the milk therefrom. However, the puncturing or shredding of milk cartons produces small cardboard fragments which contaminate the milk, thus rendering it unsuitable for human consumption.

Various pressing apparatuses are known in the art for separating liquid from solid matter. For example, U.S. Pat. No. 4,343,233 describes an apparatus for producing and collecting a liquid extract and a pressed dry by-product from a mash of fibrous material, which includes an extraction chamber and a mechanism for compressing the mash of fibrous material within the extraction chamber to extract the liquid and from a pressed dry product therefrom. In one of the embodiments disclosed in this patent, the means for compressing the mash includes two diametrically opposed fluid motors each having a plunger which is insertable within opposite ends of the extraction chamber and movable in opposed directions within the chamber to compress the mash, thereby extracting the liquid therefrom which passes through collecting openings located in the chamber and producing a pressed dry by-product. The pressed dry by-product is expelled from the extraction chamber by withdrawing one of the plungers from the extraction chamber and extending the other plunger to the end of the chamber, thereby discharging the by-product from the chamber.

U.S. Pat. No. 4,303,412 discloses a similar type of pressing apparatus for separating waste material into a liquid or semisolid sludge and a solid waste, wherein use is made of a piston arrangement designed to mass of waste. Virtually all liquid, semisolid or viscous material can thus be extracted from the waste to obtain sludge useful in agriculture.

Although such prior art presses are suitable for separating refuse into a liquid, on the one hand, and solids substantially devoid of moisture, on the other hand, they are not capable of separating large quantities of liquid such as contained in refuse milk cartons or bags, where the liquid represents more than 95% by volume of the refuse, due to the hydrostatic pressure exerted by the liquid.

SUMMARY OF THE INVENTION

It is therefore an object of the present invention to overcome the above drawbacks and to provide an apparatus for recovering liquid from refuse liquid-filled containers.

In accordance with the invention, there is thus provided an apparatus for recovering liquid from refuse liquid-filled containers, comprising an elongated compression chamber having an open end and including an inlet opening for admitting the refuse containers thereinto, the chamber being formed by a cylindrical wall having a perforated cylindrical wall portion provided with a plurality of liquid collection orifices, an annular liquid collection chamber surrounding the perforated wall portion for collecting liquid expelled through the liquid collection orifices, a first plunger movable relative to the open end of the compression chamber, and a second plunger axially movable in the compression chamber, the first and second plungers having respective first and second perforated plates mounted in spaced relationship thereto and each provided with a plurality of liquid discharge orifices.

The apparatus of the invention further includes a first plunger actuating means coupled to the first plunger for moving the first plunger to close the open end and position the first perforated plate inside the compression chamber in working relation to the perforated wall portion thereof, and a second plunger actuating means coupled to the second plunger for moving the second plunger with the second perforated plate in a direction toward the first plunger to compress the refuse container between the first and second perforated plates and thereby cause the containers to burst and expel liquid, the liquid being expressed through the liquid discharge orifices and the liquid collection orifices as the plungers move closer to one another. During compression of the containers, the first and second perforated plates together with the perforated wall portion define a strainer completely enclosing the containers with the liquid discharge orifices of the perforated plates being in liquid flow communication with the liquid collection orifices of the perforated wall portion, thereby allowing the liquid to pass freely through these orifices and into the liquid collection chamber.

According to a preferred embodiment of the invention, the open end defines an outlet opening for discharging pressed emptied containers in the form of a block, and the first and second plunger actuating means are operative to retract the first plunger for opening the outlet opening and to advance the second plunger for expelling the pressed emptied containers from the compression chamber.

The compression chamber preferably has a circular cross-section with a predetermined inner diameter.

In a preferred embodiment, the first plunger includes a shaft connected to the first plunger actuating means and a disk-shaped head mounted to the shaft, the head having a diameter greater than the inner diameter of the compression chamber. The first perforated plate has a circular configuration with a diameter slightly less than the inner diameter of the compression chamber so as to be axially frictionally engaging the cylindrical wall thereof, axial movement of the first perforated plate within the compression chamber being limited by engagement of the head with the open end of the chamber.

In another preferred embodiment, the second plunger is slidingly received in the other end of the compression chamber opposite the open end thereof, and includes a shaft connected to the second plunger actuating means and a disk-shaped head mounted to the shaft. The head has a diameter slightly less than the inner diameter of the compression chamber to define an annular gap between the head and the cylindrical wall of the chamber, a wear-resistant ring extending circumferentially about the head to close the annular gap while providing slidable frictional engagement with the cylindrical wall. Preferably, the second perforated plate has a circular configuration with a diameter generally equal to the diameter of the disk-shaped head of the second plunger.

According to a further preferred embodiment, the other end of the compression chamber is provided with a removable cover through which the shaft of the second plunger slidably extends, and the second plunger actuating means is operative to retract the second plunger so as to move same to a retracted position adjacent the other end of the chamber.

When the first plunger is moved to close the open end of the compression chamber and the second plunger is moved to the retracted position, a series of compartments are formed within the compression chamber. A first compartment is formed adjacent the open end by the cylindrical wall of the compression chamber, the first perforated plate and the disk-shaped head of the first plunger. A second compartment contiguous to the first compartment is formed by the cylindrical wall and the first and second perforated plates. A third compartment contiguous to the second compartment is formed by the cylindrical wall, the second perforated plate and the disk-shaped head of the second plunger. Finally, a fourth compartment contiguous to the third compartment is formed adjacent the other end of the compression chamber by the cylindrical wall, the disk-shaped head of the second plunger and the cover.

Since the apparatus of the invention is particularly suited for treating refuse containers filled with liquid food products such as milk, cream or fruit juice, it advantageously includes washing means for ejecting a cleaning liquid inside the various compartments formed within the compression chamber to clean the compartments and thus satisfy sanitation norms. A further washing means is also preferably arranged inside the liquid collection chamber for the same purpose.

The apparatus according to the invention enables liquid food products to be recovered from refuse containers filled with same, without contaminating the liquid food product nor affecting its organoleptic properties. The liquid food products recovered can thus be recycled for reintroduction into the food chain.

BRIEF DESCRIPTION OF THE DRAWINGS

Further features and advantages of the present invention will become more readily apparent from the following description of preferred embodiments as illustrated by way of examples in the accompanying drawings, in which.

DESCRIPTION OF PREFERRED EMBODIMENTS

Figure 1:
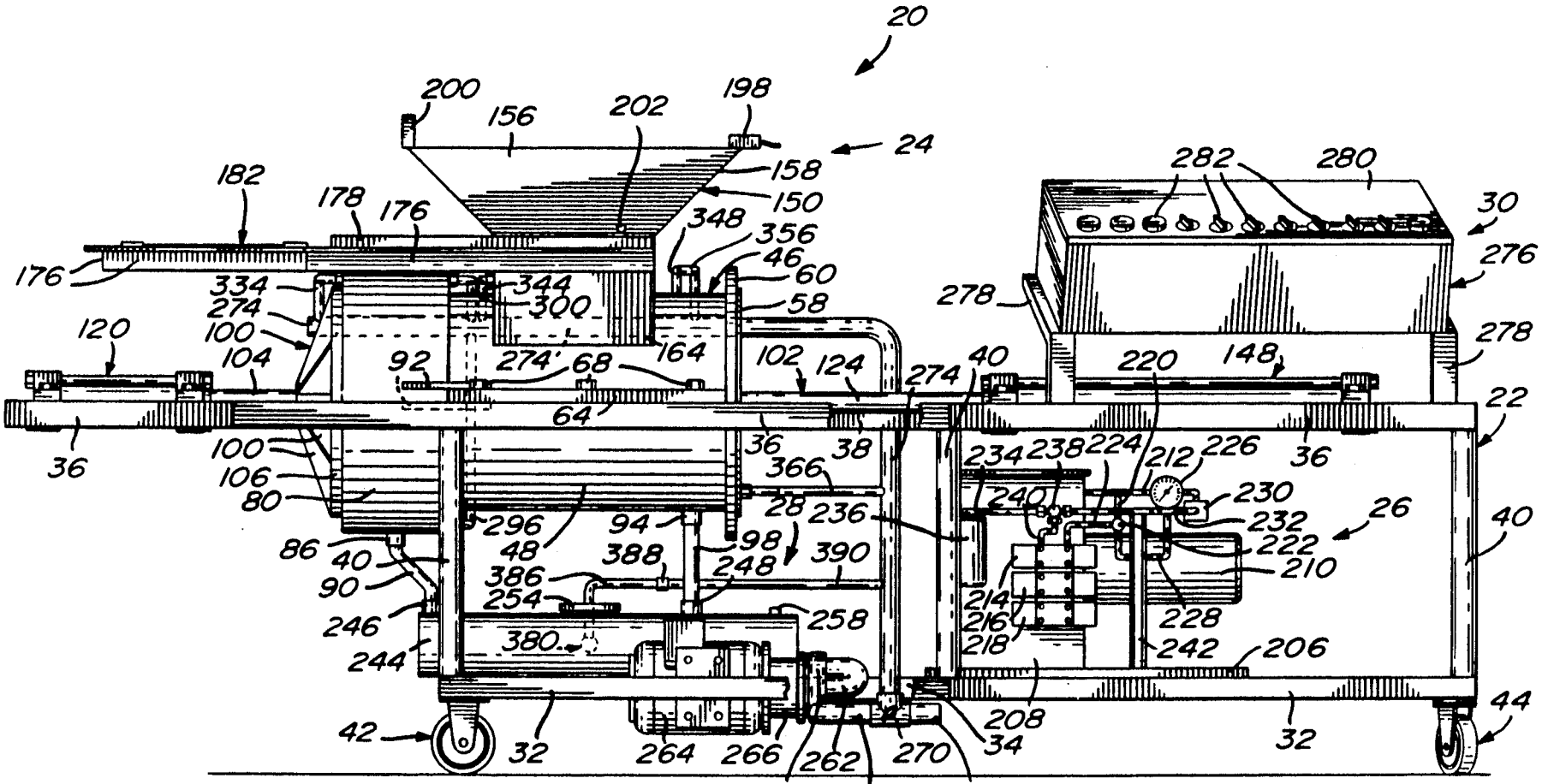
FIG. 1 is a partly-fragmented side elevational view of an apparatus according to the invention, for recovering liquid from liquid-filled containers.

Referring to the drawings and more particularly to FIGS. 1-5, there is illustrated an apparatus which is generally designated by reference numeral 20, for recovering liquid from liquid-filled containers. The apparatus 20 comprises a frame 22, a compression unit 24, a hydraulic power unit 26 for providing hydraulic power to the compression unit 24, a liquid storage tank and pump unit 28 and a control unit 30. The frame 22 comprises lower horizontal frame members 32,34 and upper horizontal frame members 36,38 as well as vertical frame members 40, and is mounted on wheels 42,44.

Figure 9:
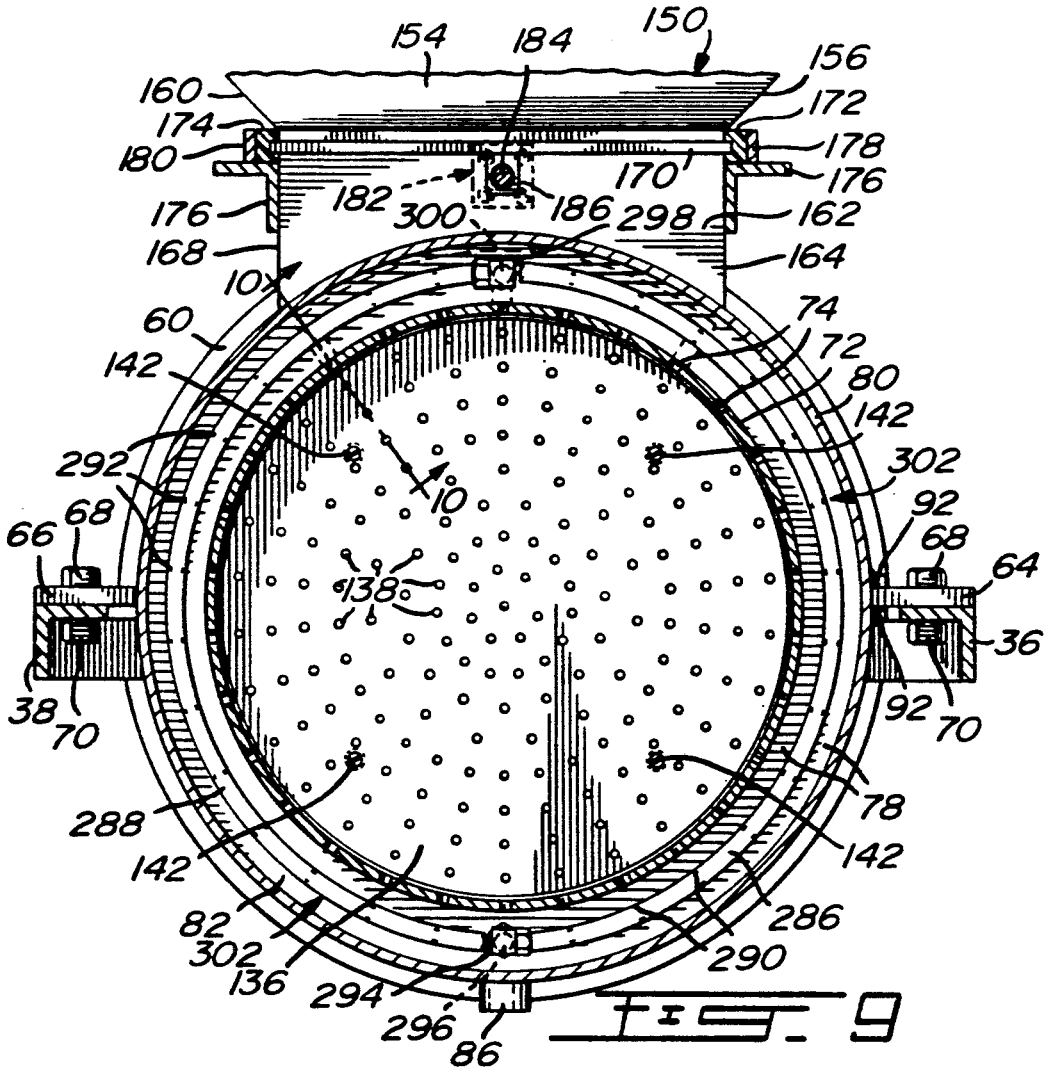
FIG. 9 is a fragmented cross-sectional view taken along lines 9—9 of FIG. 2.
Figure 11:
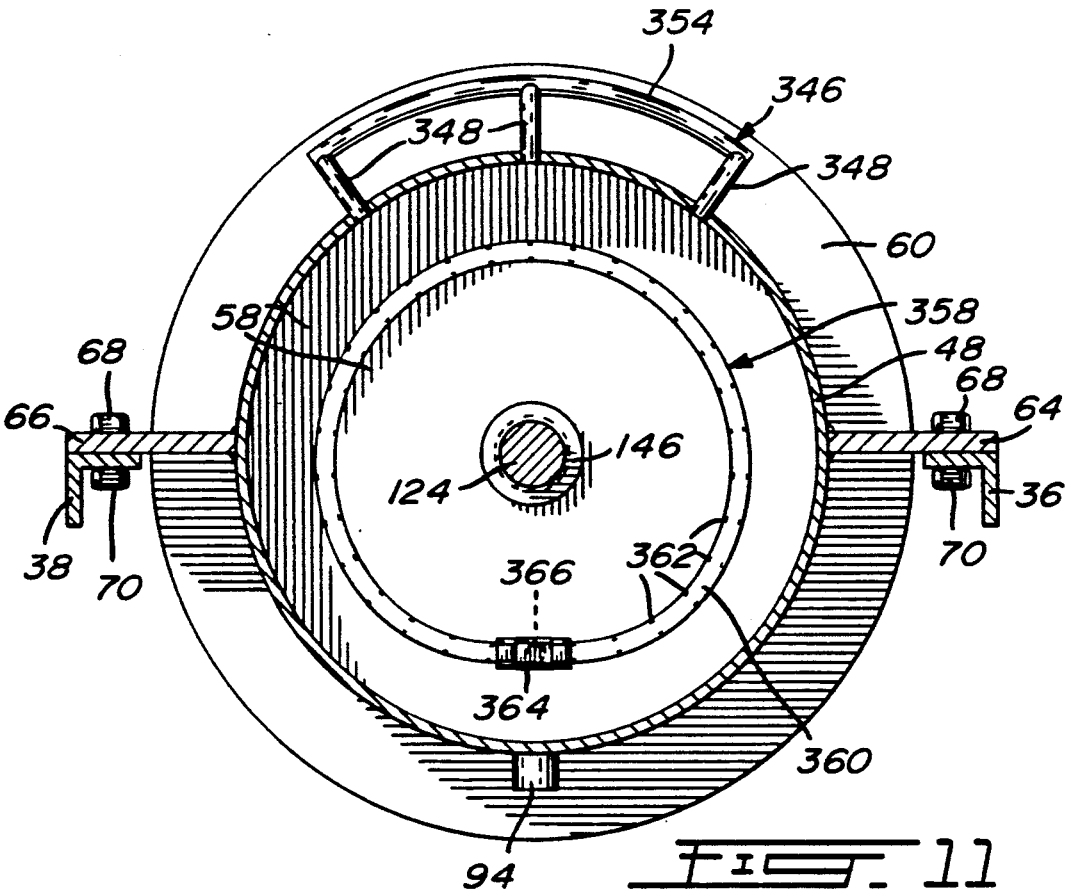
FIG. 11 is a cross-sectional view taken along lines 11—11 of FIG. 4.

The compression unit 24 includes a housing 46 with a cylindrical wall 48 of circular cross-section forming a compression chamber 50 having an inlet opening 52 and first and second open ends 54,56, the end 56 being closed by means of a cover 58 which is removably mounted to the flange 60 with screws 62. A pair of support bars 64,66 extending on either side of the housing 46 and secured thereto serve to removably mount the compression unit 24 on the upper horizontal frame members 36,38, the bars 64,66 being removably fixed to the frame members 36,38 with bolts and nuts 68,70, as best shown in FIG. 9. The wall 48 has a perforated cylindrical wall portion 72 provided with a plurality of liquid collection orifices 74. A pair of opposed spaced-apart annular sidewalls 76,78 extend circumferentially about the wall 48 and support a sleeve 80, the sidewalls 76,78 together with the sleeve 80 and the perforated wall portion 72 forming an annular liquid collection chamber 82 adjacent the open end 54 of the compression chamber 50. The sleeve 80 is removably mounted to the sidewalls 76 and 78 in order to provide access to the liquid collection chamber 82; a sealing ring 84 extends circumferentially about each sidewall to ensure a liquid tight seal between the sidewalls 76,78 and the sleeve 80, as best shown in FIG. 11. The sleeve 80 is provided with a drain outlet 86 having a drain opening 88 in liquid flow communication with the liquid collection chamber 82, the drain outlet 86 being removably connected to a drain pipe 90. A pair of spaced-apart guide-bars 92 is secured to the sleeve 80 so as to slidably receive therebetween the support bar 64, as best shown in FIG. 9; when the sleeve 80 is removed and it is desired to reposition same over the sidewalls 76,78, the guide-bars 92 together with the support bar 64 serve to guide the sleeve 80 during repositioning to ensure proper alignment of the drain outlet 86 with the drain pipe 90. Another drain outlet 94 having a drain opening 96 in liquid flow communication with the compression chamber 50 is provided adjacent the end 56 thereof and is connected to a drain pipe 98.

Figure 6:
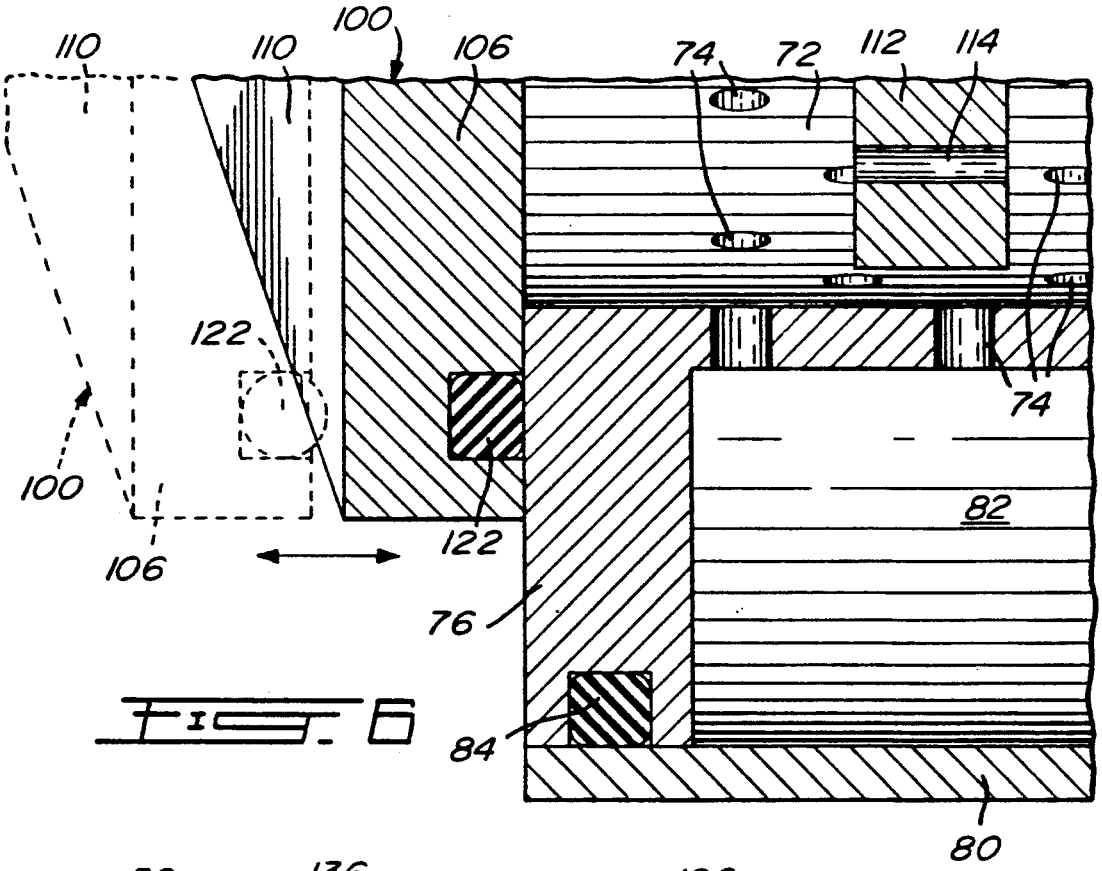
FIGS. 6 and 7 are fragmented sectional views illustrating details of the compression unit shown in FIG. 2.

The compression unit 24 further includes two plungers 100 and 102. The first plunger 100 is movable relative to the open end 54 of the compression chamber 50 whereas the second plunger 102 is slidingly received in the other end 56 of the chamber 50 for axial movement therein. The plunger 100 comprises a shaft 104 and a disk-shaped head 106 formed with a shaft mounting sleeve 108 and reinforcing gussets 110. The head 106 has a diameter greater than the inner diameter of the compression chamber 50. A perforated plate 112 of liquid discharge orifices 114 is mounted to the head 106 in spaced relationship thereto by means of hollow cylindrical spacer elements 116 and screws 118, the screws 118 being shown in FIGS. 14 and 15. The plate 112 has a diameter slightly less than the inner diameter of the compression chamber 50 so as to be axially movable within the chamber 50 without frictionally engaging the wall 48 thereof. The shaft 104 is connected to a double-action fluid motor or hydraulic piston and cylinder mechanism 120 which is mounted on the frame members 36,38. The fluid motor 120 is operative to move the plunger 100 to close the open end 54 of the compression chamber 50 and position the perforated plate 112 inside the chamber 50 in working relation to the perforated wall portion 72 thereof, axial movement of the plate 112 within the chamber 50 being limited by engagement of the head 106 with the annular sidewall 76. The head 106 is provided with a sealing ring 122 to ensure a liquid tight seal between the head 106 and the sidewall 76 when the plunger 100 is moved to close the open end 54, as best shown in FIG. 6.

Figure 7:
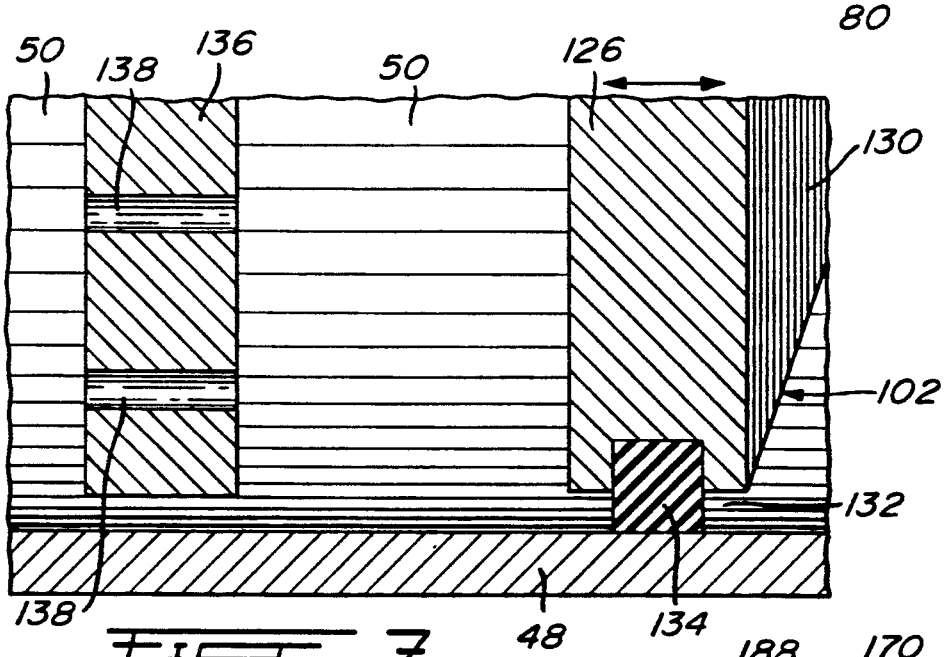

The second plunger 102 also comprises a shaft 124 and a disk-shaped head 126 formed with a shaft mounting sleeve 128 and reinforcing gussets 130. The head 126 has a diameter slightly less than the inner diameter of the compression chamber to define an annular gap 132 between the head 106 and the wall 48 of the chamber 50, a wear-resistant ring 134 extending circumferentially about the head to close the gap 132 while providing slidable frictional engagement with the wall 48, as best shown in FIG. 7. A perforated plate 136 of circular configuration provided with a plurality of liquid discharge orifices 138 is mounted to the head 126 in spaced relationship thereto by means of hollow cylindrical spacer elements 140 and screws 142, similarly as in the head and plate arrangement 106,112, the screws 142 being shown in FIG. 9. The plate 136 has a diameter generally equal to the diameter of the head 126. The shaft 124 slidably extends through an opening 144 formed in the cover 58, a sealing member 146 is provided to ensure a liquid tight seal between the cover 58 and shaft 124. The shaft 124 is also connected to a double-action fluid motor or hydraulic piston and cylinder mechanism 148 which is mounted on the frame members 36,38. The fluid motor 148 is operative to axially move the plunger 102 and perforated plate 136 inside the compression chamber 50 in a direction toward or away from the first plunger 100.

Figure 14:
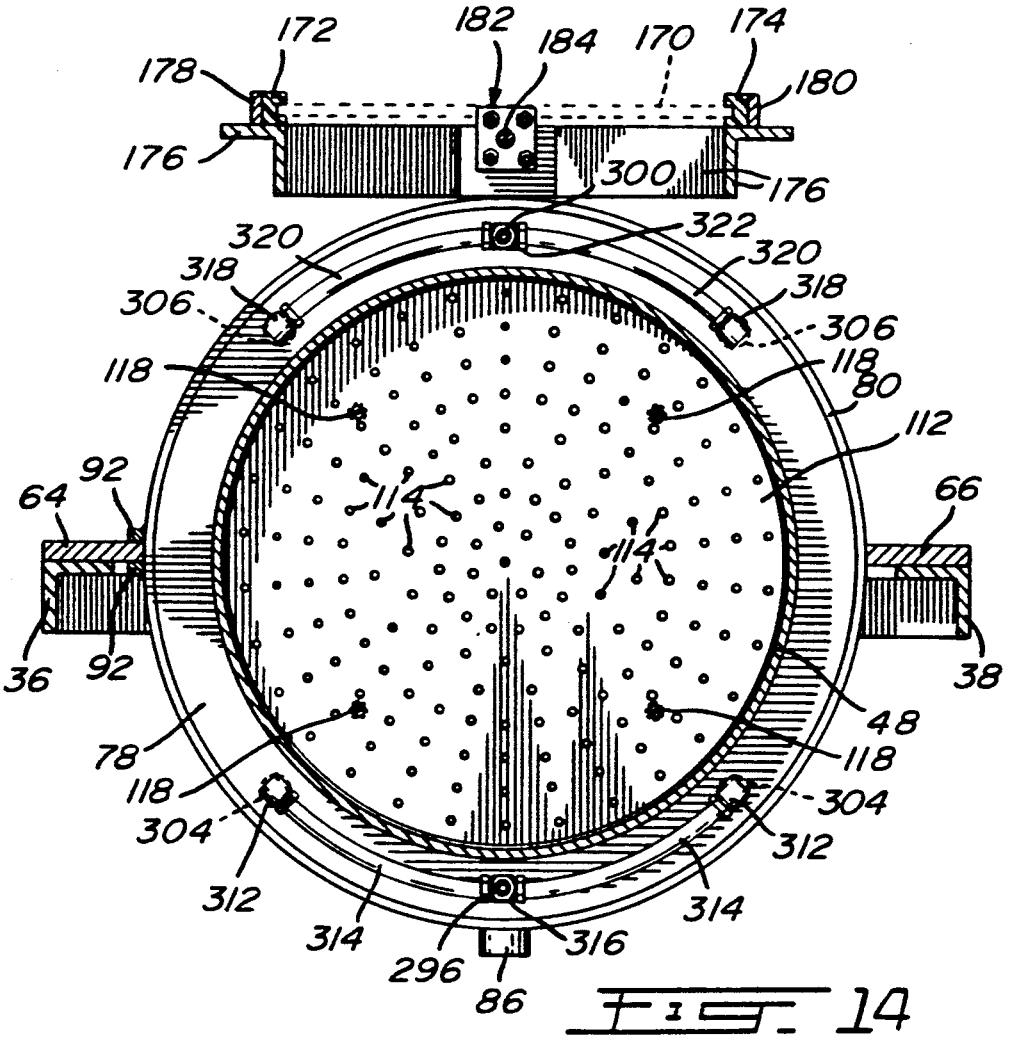
FIGS. 14 and 15 are cross-sectional views of the compression unit shown in FIG. 2, but illustrating a different type of washing means.

A hopper 150 is provided for channeling refuse liquid-filled containers 152 through the inlet opening 52 and into the compression chamber 50, between the perforated plates 112 and 136. The hopper 150 comprises four outwardly diverging walls 154, 156, 158 and 160, as well as four straight vertical walls 162, 164, 166 and 168 connected to the walls, 154, 156, 158 and 160, respectively. The hopper 150 further includes a hopper release gate 170 which is movable between open and closed positions for selectively opening or closing the inlet opening 52, thereby enabling one to fill the hopper with a supply of refuse containers 152 when the gate 170 is closed and to release the content of the hopper into the compression chamber 50 when the gate 170 is opened. The hopper release gate 170 is slidably movable in channeled guide members 172,174 which are supported on a support bar 176 of L-shaped cross-section and held in place by retaining bars 178,180 fixed to the support bar 176, as best shown in FIG. 14.

Figure 8:
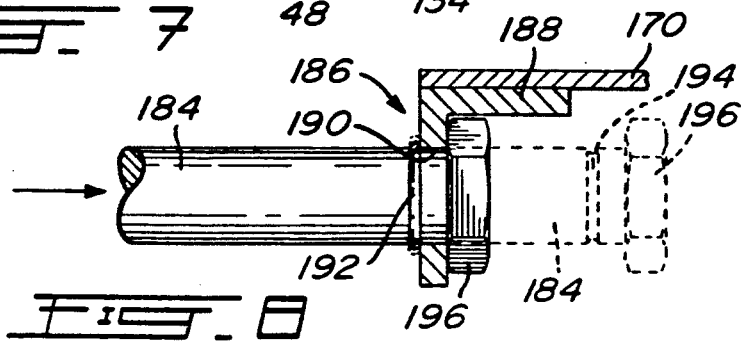
FIG. 8 is another fragmented sectional view illustrating further details of the apparatus shown in FIG. 1.

A double-action fluid motor or hydraulic piston and cylinder mechanism 182 is coupled to the hopper release gate 170 by means of a shaft 184. The gate 170 is connected to the shaft 184 by means of a safety mechanism 186 which is best illustrated in FIG. 8 and enables the gate 170 to be disengaged from the shaft 184 when the shaft 184 is moved by the fluid motor 182 in a direction to close the gate 170 and the gate encounters a resistance against its movement with the shaft 184 and when the resistance is greater than a predetermined value. As shown in FIG. 8, such a safety mechanism 186 comprises a L-shaped bracket 188 secured to the gate 170 and provided with an opening 190 through which the shaft 184 may slidably extend, and a circlip 192 engaged in a circumferential groove 194 formed in the shaft 184. The bracket 188 is releasably retained between the circlip 192 and a nut 196 which is threadably engaged with the shaft 184 at the end thereof. When the shaft 184 is moved in the direction of the arrow shown in FIG. 8 and the gate 170 encounters a resistance greater than the clamping force of the circlip 192 on the shaft 184, the circlip 192 will disengage from the groove 194, thereby allowing the shaft 184 to continue its displacement by sliding through the opening 190 formed in the bracket 188, as shown in phantom lines.

Figures 2, 3:
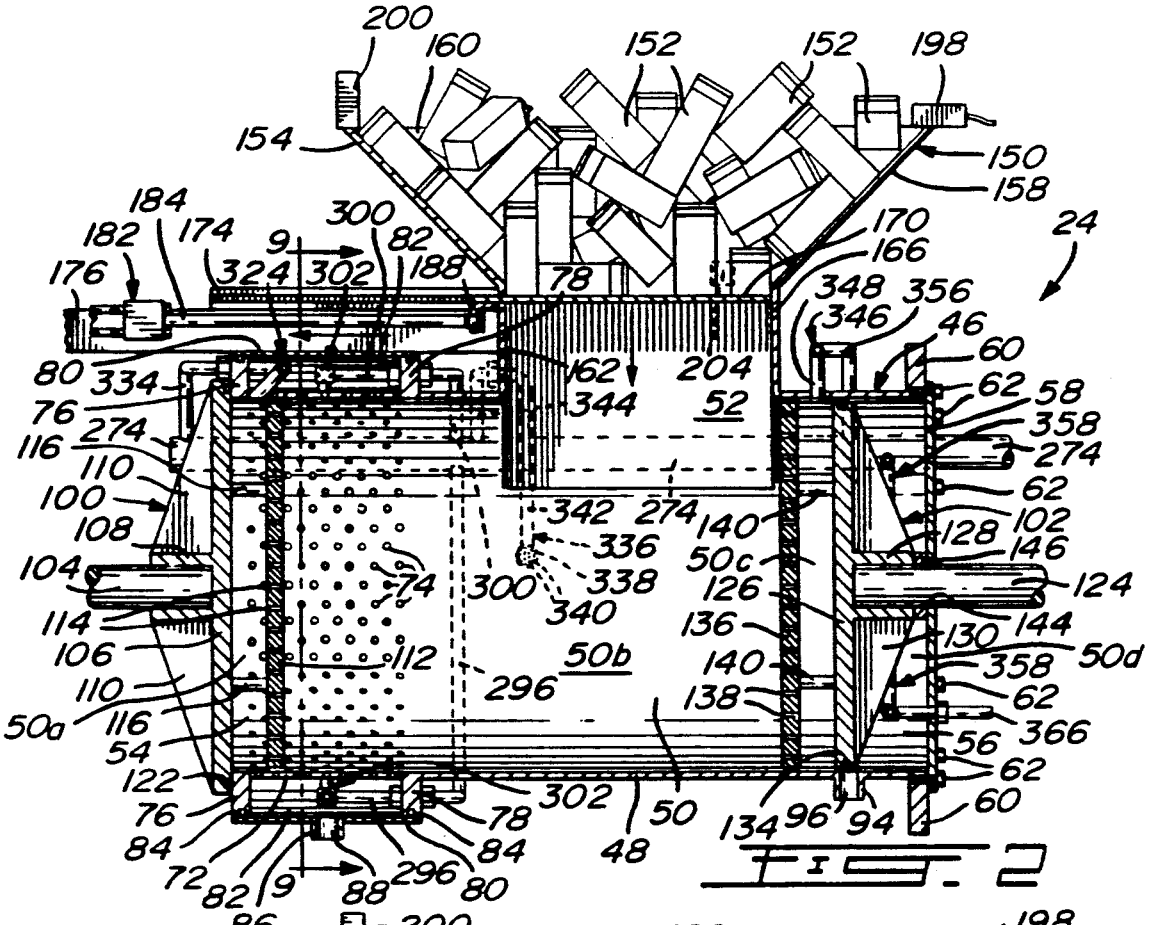
FIGS. 2 through 5 are fragmented sectional views of the compression unit of the apparatus shown in FIG. 1, illustrating the sequential steps in the process of recovering liquid from refuse liquid-filled containers.

A photocell 198 is mounted on top of the wall 158 of the hopper 150 and a reflector 200 is mounted on top of the wall 154 in alignment with the photocell 198. The photocell 198 and reflector 200 serve to issue a signal when the hopper 150 is filled with refuse containers 152 so that the hopper release gate 170 may be opened in response to such a signal when the plunger 102 is in its retracted position, as shown in FIGS. 2 and 3. Another photocell 202 and reflector 204 are arranged in the walls 156 and 160, respectively, of the hopper 150. The photocell 202 and reflector 204 serve to issue a signal when the hopper release gate 170 is moved to the closed position and an object is detected in the path of the gate 170 as it is being closed, so that the closing action of the gate 170 may be stopped and the gate 170 moved back to the open position by the fluid motor 182 in response to the signal issued by the photocell 202. Moreover, if the plunger 102 has started its movement toward the plunger 100, further movement of the plunger 102 will be stopped in response to the signal issued by the photocell 202. Thus, for example, if an operator moves his hand into the hopper 150 through the inlet opening 52 after the hopper release gate 170 has been opened to release the content of the hopper into the compression chamber 50 and the gate 170 starts its movement toward the closed position, the photocell 202 will detect the operator's hand and issue a signal so as to immediately retract the gate 170 and also stop any movement of the plunger 102, thereby preventing the operator's hand from being crushed.

The hydraulic power unit 26 which is supported on a base plate 206 fixed to the frame members 32,34 comprises a hydraulic fluid tank 208 and a motor 210 for actuating a hydraulic pump (not shown) inside the fluid tank 208. A fluid line 212 is connected to the hydraulic pump and serves to supply hydraulic fluid to control valves 214, 216 and 218 via the fluid line 220 interconnecting fluid line 212 with check valve 222 and the fluid line 224 interconnecting the check valve 222 with the control valves 214,216,218. A pressure gauge 226 is connected to the check valve 222 via line 228. The control valves 214, 216 and 218 are connected to fluid motors 120, 148 and 182, respectively, by suitable fluid lines (not shown). The fluid feed line 212 is also connected to a pressure release valve 230 which in turn is connected to an over-pressure release line 232. A fluid return line 234 provided with a filter 236 is connected via a T-connector 238 and line 240 to the control valves 214, 216 and 218 which return the hydraulic fluid from the fluid motors 120, 148 and 182 back to the fluid tank 208. The over-pressure release line 232 is also connected to the T-connector 238 for returning surplus fluid via line 240 and control valves 214,216,218 to the tank 208. The fluid lines 212 and 232 are supported by member 242 fixed to the base plate 206.

Figure 13:
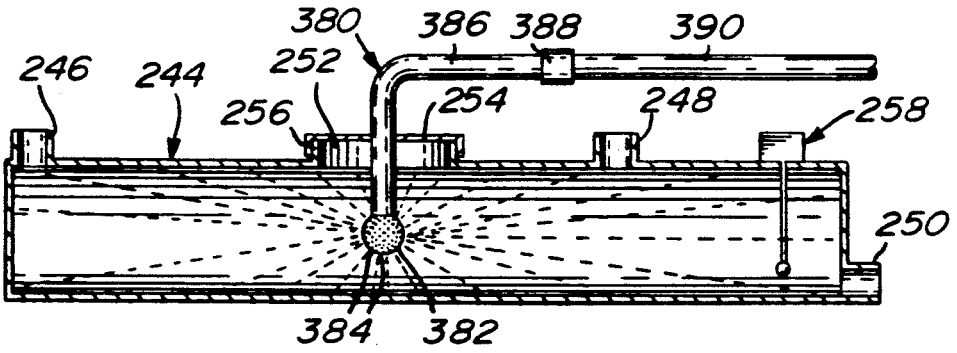
FIG. 13 is a sectional view of the liquid storage tank of the apparatus shown in FIG. 1.

The storage tank and pump unit 28 comprises a liquid storage tank 244 having a first liquid inlet 246 which is connected to the drain outlet 86 of the liquid collection chamber 82 by the drain pipe 90, and a second liquid inlet 248 which is connected to the drain outlet 94 of the compression chamber 50 by the drain pipe 98. The tank 244 is also provided with a liquid outlet 250 and a top aperture 252 which is closed by a removable cap 254 resting on flange 256, as best shown in FIG. 13. A level gauge 258 is provided for monitoring the level of liquid in the tank 244. The unit 28 further includes a pump 260 which is connected to the tank outlet 250 by the conduit 262. The pump 260 is actuated by a motor 264 #connected to the pump 260 by an adaptor 266. The pump outlet is connected by a conduit 268 to a three-way valve 270 which interconnects the conduit 268 with a liquid discharge conduit 272 or a liquid recirculation conduit 274.

The control unit 30 comprises a housing 276 mounted to the frame member 36 by means of a pair of brackets 278. The housing 276 has a top control panel 280 provided with a plurality of control knobs 282 which are connected to a programmable controller (not shown) inside the housing 276.

Figure 4:
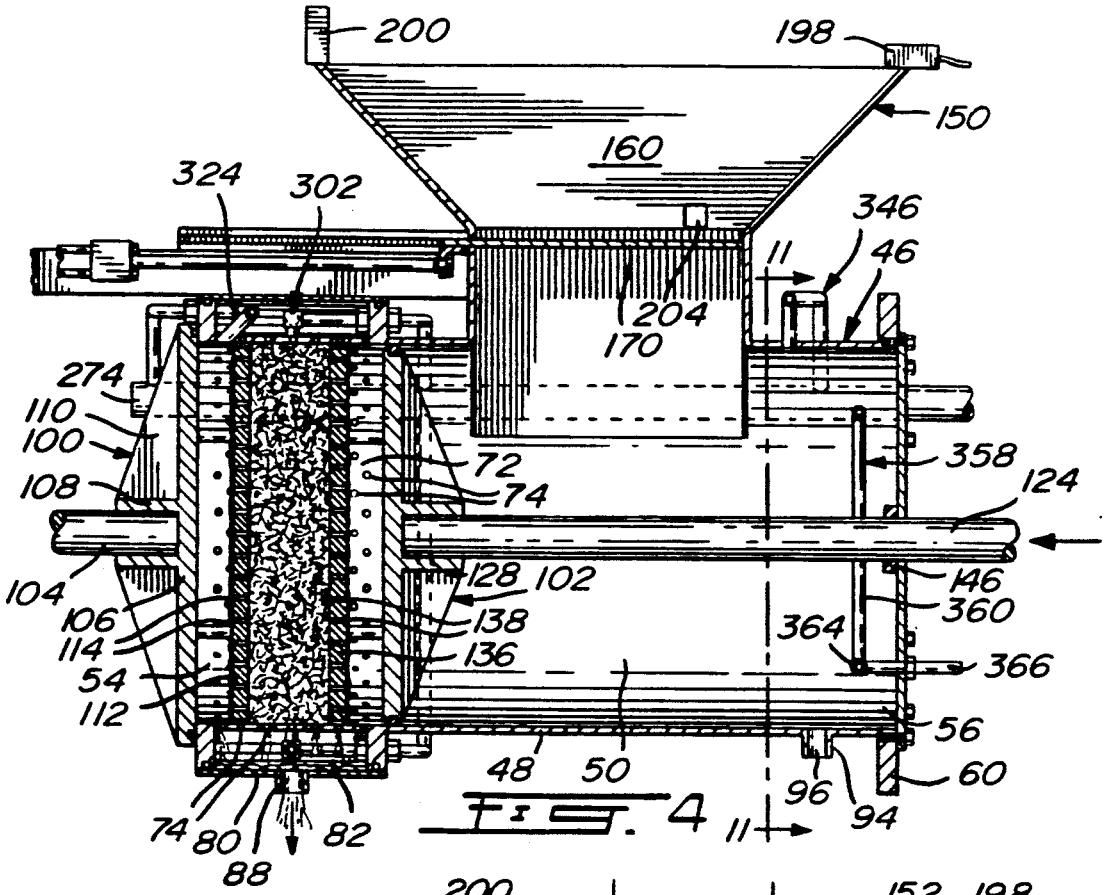
Figure 5:
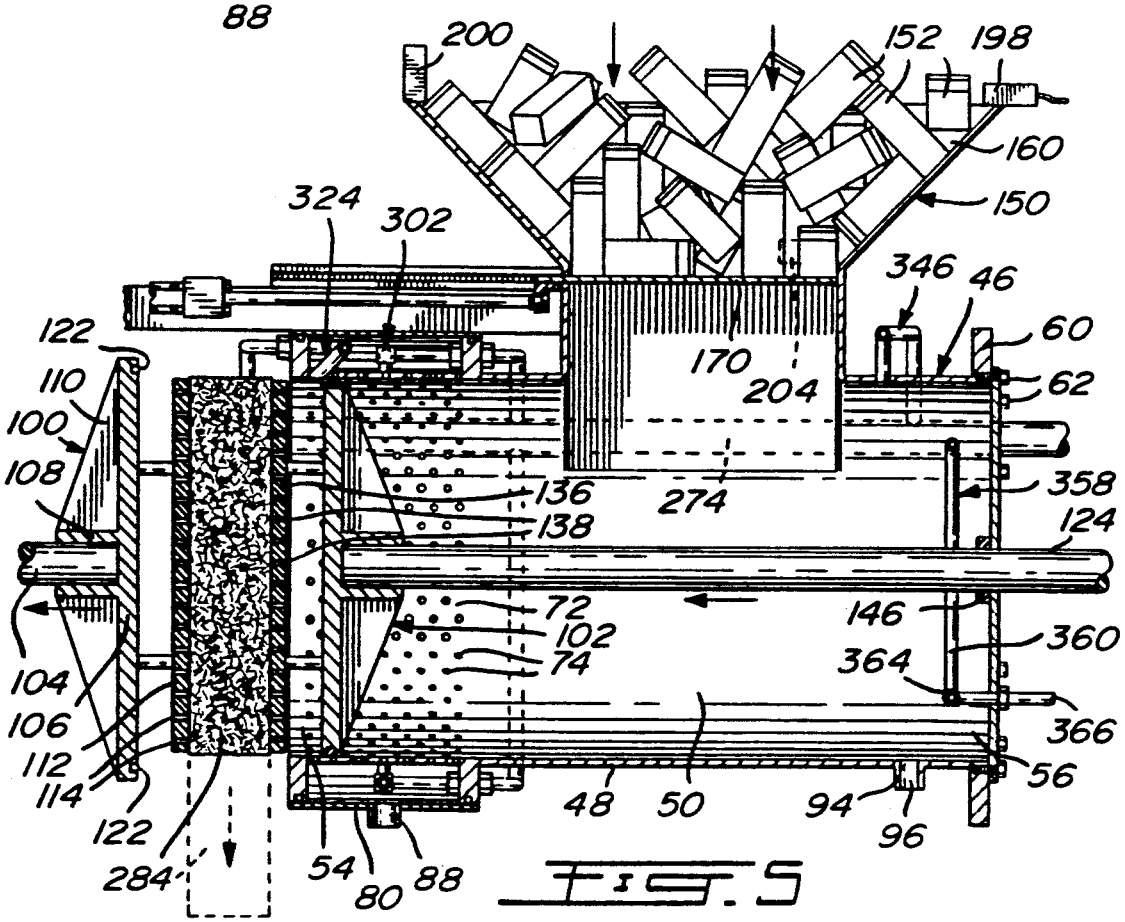

FIGS. 2–5 illustrate the sequential steps in the process of recovering liquid from refuse liquid-filled containers 152. Referring to FIG. 2, the compression unit 24 is shown with the hopper release gate 170 closed and the hopper 150 filled with refuse containers 152. The plunger 100 is in a position closing the open end 54 of the compression chamber 50 whereas the plunger 102 is in its retracted position adjacent the other end 56 of the chamber 50. When the hopper release gate 170 is moved to the open position by the fluid motor 182 in response to the signal issued by the photocell 198, the refuse containers 152 fall through the inlet opening 52 into the compression chamber 50, between the perforated plates 112,136 of the plungers 100,102, as shown in FIG. 3. The hopper release gate 170 is then closed and the plunger 102 is moved by the fluid motor 148 in a direction toward the plunger 100 to compress the refuse containers 152 between the perforated plates 112,136, thereby causing the containers 152 to burst and expel liquid, as shown in FIG. 4. The liquid is expressed through the liquid discharge orifices 114,138 of the perforated plates 112,136 and through the liquid collection orifices 74 of the perforated wall portion 72 as the plunger 102 moves closer to the plunger 100.

Thus, during compression of the containers 152, the perforated plates 112,136 together with the perforated wall portion 72 define a strainer completely enclosing the containers 152 with liquid discharge orifices 114,138 being in liquid flow communication with the liquid collection orifices 74, thereby allowing the liquid to pass freely through the orifices 74,114,138 into the liquid collection chamber 82. Moreover, since the containers 152 burst open at their sealed top opening which offers the least resistance to the increase of hydrostatic pressure inside the containers during their compression, there is no contamination of the liquid expressed by fragments of the containers. The liquid collected in the chamber 82 is discharged through the drain orifice 88 and channeled by the drain pipe 90 to the liquid storage tank 244. When the containers 152 have been fully pressed, the plunger 100 is retracted for opening the end 54 of the compression chamber 50 and the plunger 102 is further axially extended into the chamber 50 so as to expel the pressed emptied containers in the form of a block 284 through the open end 54, as illustrated in FIG. 4. In the meantime, the hopper 150 is filled with another load of refuse containers 152 so that when the plunger 100 is moved to close the open end 54 and the plunger 102 is returned to its retracted position as illustrated in FIG. 2, the hopper release gate 170 may be opened to release the content of the hopper 150 into the compression chamber 50 for another compression cycle.

When the storage tank 244 is filled with the liquid discharged from the liquid collection chamber 82, the three-way valve 270 is actuated so that the conduit 268 is in liquid flow communication with the conduit 272. The pump 260 is then actuated to discharge the liquid from the tank 244 through conduits 262, 268 and 272 into another tank or reservoir of larger capacity.

Figure 10:
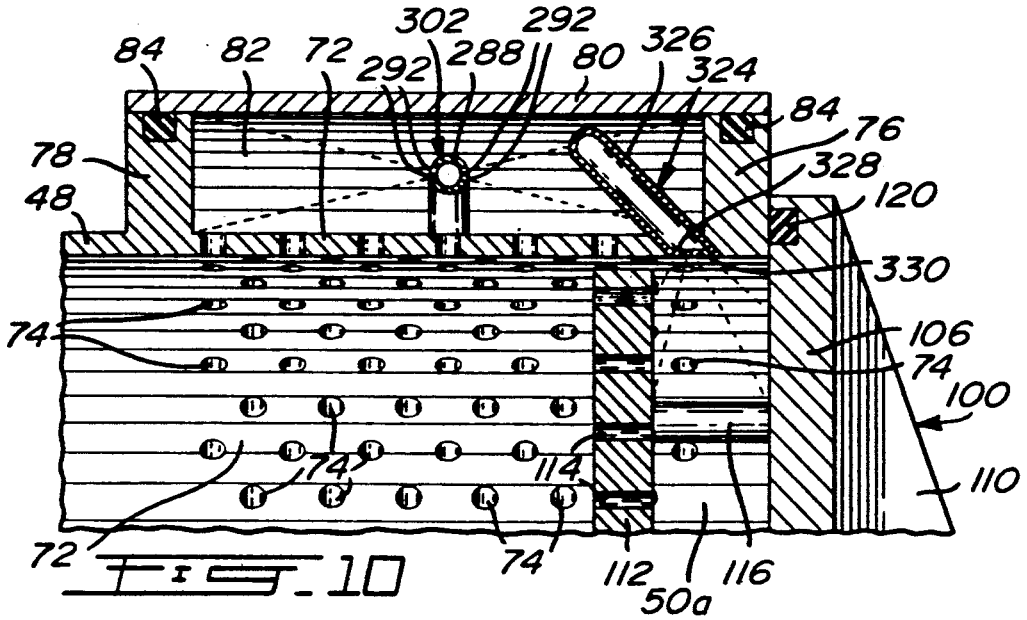
FIG. 10 is a fragmented sectional view taken along lines 10—10 of FIG. 9.

Since the apparatus 20 is particularly suited for treating refuse containers filled with liquid food products such as milk, cream or fruit juice, it further includes a plurality of washing devices for cleaning the liquid collection chamber 82, the liquid storage tank 244 as well as the various compartments **50*a*, 50*b*, 50*c* and 50*d* formed within the compression chamber 50 when the plunger 100 is in a position closing the open end 54 of the chamber 50 and the plunger 102 is in its retracted position as illustrated in FIG. 2. Referring to FIGS. 2, 9 and 10, two semi-circular perforated conduits 286,288 are arranged inside the liquid collection chamber 82 for cleaning same. The conduits 286 and 288 are provided with a plurality of liquid ejection orifices 290 and 292, respectively, which are spaced along the length thereof. The perforated conduit 286 is connected by means of a coupling 294 to a feed conduit 296 which in turn is connected to the recirculation conduit 274. Similarly, the perforated conduit 288 is connected by a coupling 298 to a feed conduit 300 which in turn is connected to the recirculation conduit 274. The conduits 286 and 288 are disposed end-to-end to define an annular liquid ejection system 302 extending around the perforatad wall portion 72 for directing jets of cleaning liquid at predetermined locations inside the liquid collection chamber 82, as shown in FIG. 10**.

Figure 15:
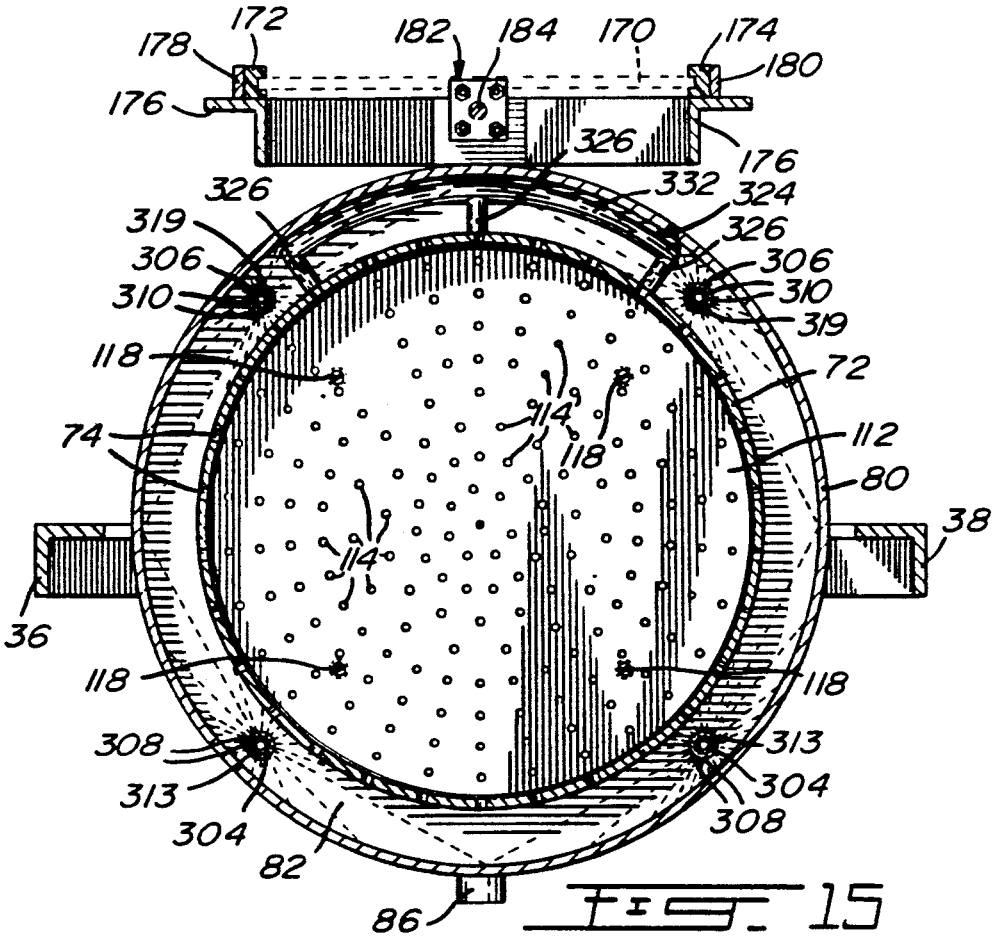

As illustrated in FIGS. 14 and 15, instead of using two semi-circular perforated conduits 286,288 for cleaning the liquid collection chamber 82, it is also possible to arrange a plurality of hollow perforated spheres 304,306 inside the chamber 82. The spheres 304 and 306 are provided with a plurality of liquid ejection orifices 308 and 310, respectively, which are spaced therearound. The spheres 304 are connected to couplings 312 located exteriorly of the chamber 82 by conduits 313 extending through the wall 78; the couplings 312 are connected to arcuate conduits 314 which in turn are connected to the feed conduit 296 by a coupling 316. Similarly, the spheres 306 are connected to couplings 318 located exteriorly of the chamber 82 by conduits 319 extending through the wall 78; the couplings 318 are connected to arcuate conduits 320 which in turn are connected to the feed conduit 300 by a coupling 322. The perforated spheres 304,306 are thus spaced from one another around the perforated wall portion 72 to define a liquid ejection system for ejecting jets of cleaning liquid at predetermined locations inside the liquid collection chamber 82, as shown in FIG. 15.

A second washing device 324 is arranged in the liquid collection chamber 82 for ejecting a cleaning liquid inside the compartment 50*a* formed by the perforated wall portion 72, the disk-shaped head 106 and the perforated plate 112, in order to clean the compartment 50*a*. As illustrated in FIGS. 10 and 15, the washing device 324 comprises a plurality of spaced-apart conduits 326 extending through the perforated wall portion 72 and each having an end 328 provided with a plurality of liquid ejection orifices 330 opening into the compartment 50*a*. The conduits 326 are connected together by a bridge conduit 332 which in turn is connected to a feed conduit 334. The feed conduit 334 is connected to the recirculation conduit 274. The conduits 326 are spaced from one another around an arcuate segment of the perforated wall portion 72 to define a liquid ejection system for directing jets of cleaning liquid at predetermined locations inside the compartment 50*a*, as shown in FIG. 10.

A third washing device 336 is provided for cleaning the compartment 50*b* formed by the cylindrical wall 48 and the perforated plates 112,136. The washing device 336 which is illustrated in broken lines in FIG. 2 and is removably mounted to the wall 162 of the hopper 150 comprises a hollow perforated sphere 338 disposed within the compartment 50*b*. The sphere 338 is provided with a plurality of liquid ejection orifices 340 spaced therearound. A conduit 342 extending through the inlet opening 52 and removably fixed to the wall 162 underneath the hopper release gate 170 is connected to the sphere 338. The conduit 342 is also releasably connected to a feed conduit 344 which in turn is connected to the recirculation conduit 274. The conduits 342,344 serve to supply a cleaning fluid from the recirculation circulation conduit 274 to the perforated sphere 338, thereby causing the sphere 338 to direct jets of cleaning liquid inside the compartment 50*b*.

Figure 12:
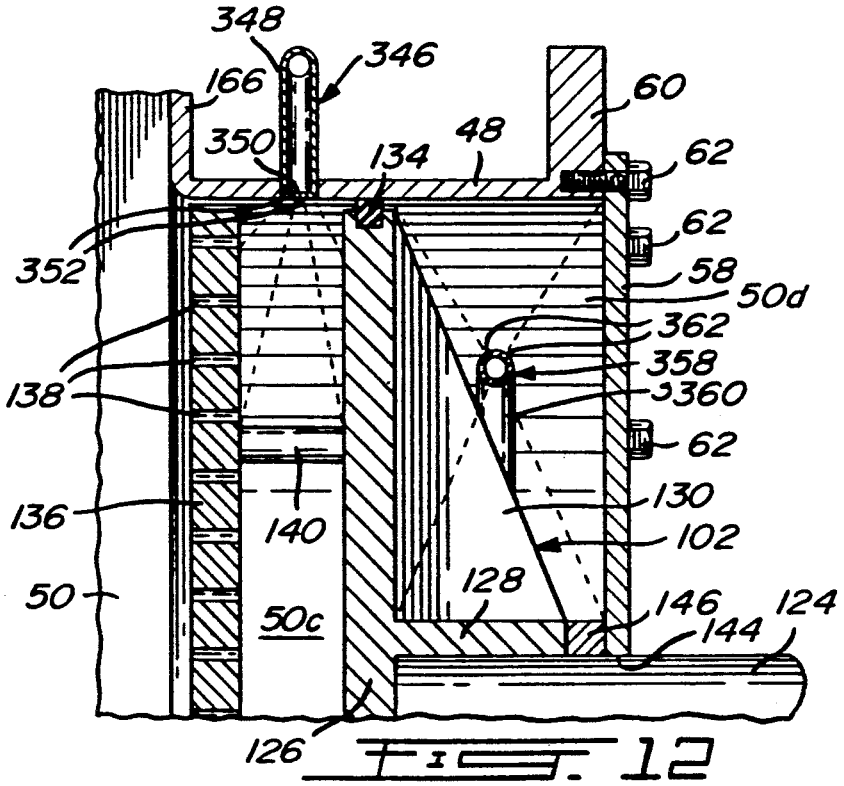
FIG. 12 is a fragmented sectional view of the compression unit shown in FIG. 2, illustrating details of the washing means shown in FIG. 11.

A fourth washing device 346 is provided for cleaning the compartment 50*c* formed by the cylindrical wall 48, the disk-shaped head 126 and the perforated plate 136. As illustrated in FIGS. 11 and 12, the washing device 346 is similar to the device 324 for cleaning the compartment 50*a* and comprises a plurality of spaced-apart conduits 348 extending through the cylindrical wall 48 and each having an end 350 provided with a plurality of liquid ejection orifices 352 opening into the compartment 50*c*. The conduits 348 are connected together by a bridge conduit 354 which in turn is connected to a fluid conduit 356. The feed conduit 356 is connected to the recirculation conduit 274. The conduits 348 are spaced from one another around an arcuate segment of the wall 48 to define a liquid ejection system for directing jets of cleaning liquid at predetermined locations inside the compartment 50*c*, as shown in FIG. 12.

A fifth cleaning device 358 is arranged adjacent the end 56 of the compression chamber 50 for cleaning the compartment 50*d* formed by the cylindrical wall 48, the cover 58 and the disk-shaped head 126. As illustrated in FIGS. 11 and 12, the washing device 358 comprises an annular perforated conduit 360 provided with a plurality of liquid ejection orifices 362 spaced along the length thereof. The conduit 360 is connected by means of a coupling 364 to a feed conduit 366 which in turn is connected to the recirculation conduit 274. The perforated conduit 360 extends around the shaft 124 of the plunger 102 and is disposed adjacent the cover 58 to define a liquid ejection system for directing jets of cleaning liquid at predetermined locations inside the compartment 50*d*, as shown in FIG. 12.

Figure 16:
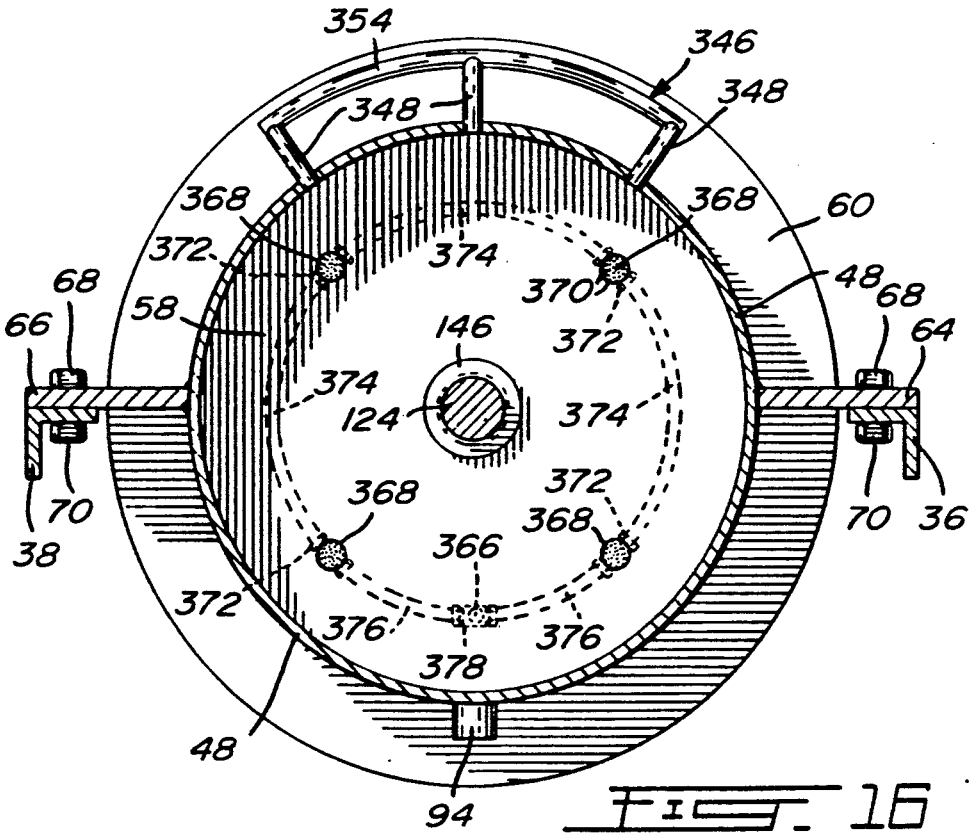
FIG. 16 is a cross-sectional view similar to FIG. 11, but illustrating a washing means according to another preferred embodiment of the invention.

As illustrated in FIG. 16, instead of using i an annular perforated conduit 360 for cleaning the compartment 50*d*, it is also possible to arrange a plurality of hollow perforated spheres 368 around the shaft 124 adjacent the cover 58. The spheres 368 are provided with a plurality of liquid ejection orifices 370 spaced therearound. The spheres 368 are connected to couplings 372 located exteriorly of the chamber 50, by conduits (not shown) extending through the cover 58. The couplings 372 are interconnected by arcuate conduits 374,376, the conduits 376 being connected to the feed conduit 366 by a coupling 378. The perforated spheres 368 are thus spaced from one another around the shaft 124 and disposed adjacent the cover 58 to define a liquid ejection system for directing jets of cleaning liquid at predetermined locations inside the compartment 50*d*.

Another washing device 380 is removably arranged inside the liquid storage tank 244 for cleaning same. As illustrated in FIG. 13, the washing device 380 comprises a hollow perforated sphere 382 provided with a plurality of liquid ejection orifices 384 spaced therearound. A conduit 386 extending through the aperture 252 and cap 254 is connected to the sphere 382. The conduit 386 is also releasably connected by a coupling 388 to a feed conduit 390 which in turn is connected to the recirculation 274. The washing device 380 is thus removable with the cap 254. The conduits 386,390 serve to supply a cleaning liquid from the recirculation conduit 274 to the perforated sphere 382, thereby causing the sphere 382 to direct jets of cleaning liquid inside the tank 244.

When the liquid storage tank 244 has been emptied and it is desired to activate the wash cycle of the apparatus 20, the three-way valve 270 is actuated so that the conduit 268 is in liquid flow communication with the recirculation conduit 274. The tank 244 is partially filled with a cleaning liquid by pouring the cleaning liquid through the inlet opening 52 into the compression chamber 50, the cleaning liquid being discharged through the drain openings 88,96 and channeled by the drain pipes 90,98 into the tank 244. The hopper release gate 170 is then closed and the pump 260 is actuated so as to recirculate the cleaning liquid through the conduit 274 and thereby feed the cleaning liquid to the washing devices 302, 324, 336, 346, 358 and 380. Once the wash cycle has been completed, the cleaning liquid is discharged from the tank 244 by actuating the valve 270 so that the conduit 268 is in liquid flow communication with the discharge conduit 272.

The apparatus 20 enables liquid food products to be recovered from refuse containers filled with same, without contaminating the liquid food product nor affecting its organoleptic properties. Due to the provision of washing devices 302, 324, 336, 346, 358 and 380, the apparatus 20 also satisfies sanitation norms

I claim:

1. An apparatus for recovering liquid from refuse liquid-filled containers, comprising:

an elongated compression chamber having an open end and including an inlet opening for admitting said refuse containers thereinto, said chamber being formed by a cylindrical wall having a perforated cylindrical wall portion provided with a plurality of liquid collection orifices;

an annular liquid collection chamber surrounding said perforated wall portion for collecting liquid expelled through said liquid collection orifices;

a first plunger movable relative to said open end;

a second plunger axially movable in said compression chamber, said first and second plungers having respective first and second heads with respective first and second perforated plates mounted thereon, each head having a lead surface and the respective heads and perforated plates of said first and second plungers being arranged at one extremity of each said plunger, each plate being provided with a plurality of liquid discharge orifices and being mounted on a respective head in spaced-apart relation to define a gap between each plate and substantially the whole lead surface of each head, said gap permitting liquid flow communication between said liquid discharge orifices and said liquid collection orifices;

a first plunger actuating means coupled to said first plunger for moving said first head to close said open end and position said first perforated plate inside said compression chamber in working relation to the perforated wall portion thereof; and a second plunger actuating means coupled to said second plunger for moving said second head with said second perforated plate in a direction toward said first head to compress said refuse containers between said first and second perforated plates and thereby cause said containers to burst and expel liquid, said liquid being expessed through said liquid discharge orifices and said liquid collection orifices as said plungers move closer to one another;

whereby during compression of said containers, said first and second perforated plates together with said perforated wall portion define a strainer completely enclosing said containers such that said liquid passes freely through said liquid discharge orifices and said liquid collection orifices, and directly into said liquid collection chamber.

2. An apparatus according to claim 1, wherein said open end defines an outlet opening for discharging pressed emptied containers in the form of a block, and wherein said first and second plunger actuating means are operative to retract said first head for opening said outlet opening and to advance said second head for expelling said pressed emptied containers from said compression chamber.

3. An apparatus according to claim 2, wherein said compression chamber has another end opposite said open end, said second plunger being slidingly received in said other end of said chamber.

4. An apparatus according to claim 3, wherein said second plunger includes a shaft connected to said second plunger actuating means and said second head is a disk-shaped head mounted on said shaft, said second head having a diameter slightly less than the inner diameter of said compression chamber to define an annular gap between said second head and the cylindrical wall of said chamber a wear-resistant ring extending circumferentially about said second head to close said annular gap while providing slidable frictional engagement with said wall.

5. An apparatus according to claim 4, wherein said second perforated plate has a circular configuration with a diameter generally equal to the diameter of said second head.

6. An apparatus according to claim 4, wherein the other end of said compression chamber is provided with a removable cover through which the shaft of said second plunger slidably extends, and wherein said second plunger actuating means is operative to retract said second plunger so as to move said second head to a retracted position adjacent said other end.

7. An apparatus according to claim 6, wherein the cylindrical wall of said compression chamber together with said cover and said second head form a first compartment within said compression chamber adjacent the other end thereof when said second head is moved to said retracted position, and wherein a first washing means is provided adjacent said other end of said compression chamber for cleaning said first compartment.

8. An apparatus according to claim 7, wherein said first washing means comprises an annular perforated conduit provided with a plurality of liquid ejection orifices spaced along the length thereof, said perforated conduit extending around the shaft of said second plunger and being disposed between said second head and said cover to define a liquid ejection system for directing jets of cleaning liquid at predetermined locations inside said first compartment.

9. An apparatus according to claim 7, wherein said first washing means comprises a plurality of hollow perforated spheres each provided with a plurality a liquid ejection orifices spaced therearound, said perforated spheres being spaced from one another around the shaft of said second plunger and disposed between said second head and said cover to define a liquid ejection system for directing jets of cleaning liquid at predetermined locations inside said first compartment.

10. An apparatus according to claim 7, wherein the cylindrical wall of said compression chamber together with said second perforated plate and said second head form a second compartment which is separated from said first compartment by said second head, and wherein a second washing means is provided adjacent said other end of said compression chamber for cleaning said second compartment.

11. An apparatus according to claim 10, wherein said second washing means comprises a plurality of conduits extending through said cylindrical wall and each having an end provided with a plurality of liquid ejection orifices opening into said second compartment, said conduits being spaced from one another around an arcuate segment of said cylindrical wall to define a liquid ejection system for directing jets of cleaning liquid at predetermined locations inside said second compartment.

12. An apparatus according to claim 10, wherein said compression chamber is provided with a liquid outlet opening adjacent said other end of said compression chamber for discharging the cleaning liquid from said first and second compartments.

13. An apparatus according to claim 1, wherein said compression chamber is circular in cross-section and has a predetermined inner diameter.

14. An apparatus according to claim 13, wherein said first plunger includes a shaft connected to said first plunger actuating means and said first head is a disk-shaped head mounted on said shaft, said first head having a diameter greater than the inner diameter of said compression chamber, and wherein said first perforated plate has a circular configuration with a diameter slightly less than the inner diameter of said compression chamber so as to be axially movable within said compression chamber without frictionally engaging the cylindrical wall thereof, axial movement of said first perforated plate within said compression chamber being limited by engagement of said first head with the open end of said chamber.

15. An apparatus according to claim 14, wherein said first head comprises sealing means for providing a liquid tight seal between said first head and the open end of said compression chamber.

16. An apparatus according to claim 14, wherein said liquid collection chamber is located adjacent the open end of said compression chamber, and wherein a pair of opposed spaced-apart annular sidewalls extend circumferentially about the cylindrical wall of said compression chamber and support a sleeve, said sidewalls together with said sleeve and said perforated wall portion forming said annular liquid collection chamber.

17. An apparatus according to claim 16, wherein said sleeve is removably mounted to said sidewalls to provide access to said liquid collection chamber, and wherein a sealing ring extends circumferentially about each sidewall to provide a liquid tight seal between said sidewalls and said sleeve.

18. An apparatus according to claim 17, wherein a first washing means is arranged in said liquid collection chamber for cleaning same.

19. An apparatus according to claim 18, wherein said first washing means comprises two semi-circular perforated conduits each provided with a plurality of liquid ejection orifices spaced along the length thereof, said perforated conduits being disposed end-to-end to define an annular liquid ejection system extending around said perforated wall portion for directing jets of cleaning liquid at predetermined locations inside said liquid collection chamber.

20. An apparatus according to claim 18, wherein said first washing means comprises a plurality of hollow perforated spheres each provided with a plurality of liquid ejection orifices spaced therearound, said perforated spheres being spaced from one another around said perforated wall portion to define a liquid ejection system for directing jets of cleaning liquid at a predetermined locations inside said liquid collection chamber.

21. An apparatus according to claim 18, wherein the cylindrical wall of said compression chamber together with said first perforated plate and said first head form a compartment within said compression chamber adjacent the open end thereof when said first head is moved to close said open end, and wherein a second washing means is arranged in said liquid collection chamber for ejecting a cleaning liquid inside said compartment to clean same.

22. An apparatus according to claim 21, wherein said second washing means comprises a plurality of conduits extending through said perforated wall portion and each having an end provided with a plurality of liquid ejection orifices opening into said compartment, said conduits being spaced from one another around an arcuate segment of said perforated wall portion to define a liquid ejection system for directing jets of said cleaning liquid at predetermined locations inside said compartment.

23. An apparatus according to claim 1, wherein said inlet opening includes a hopper for channeling said refuse containers through said inlet opening into said compression chamber.

24. An apparatus according to claim 23, further including a hopper release gate movable between open and closed positions for selectively opening or closing said inlet opening, and means for moving said hopper release gate between said open and closed positions.

25. An apparatus according to claim 24, wherein said moving means comprises a gate actuating means coupled to said hopper release gate by means of a shaft, said gate actuating means being operative to selectively displace said shaft axially in one direction for moving said gate to said closed position or in an opposite direction for moving said gate to said open position.

26. An apparatus according to claim 25, wherein said hopper release gate is connected to said shaft by means of a safety mechanism enabling said gate to be disengaged from said shaft when said shaft is moved in said one direction and said gate encounters a resistance against its movement with said shaft and when said resistance is greater than a predetermined value.

27. An apparatus according to claim 24, wherein said compression chamber has another end opposite said open end, said second plunger being slidingly received in said other end of said chamber, and wherein said second plunger actuating means is operative to retract said second plunger so as to move said second head to a retracted position adjacent said other end.

28. An apparatus according to claim 27, wherein the cylindrical wall of said compression chamber together with said first and second perforated plates form a compartment within said compression chamber when said first head is moved to close said open end and said second head is moved to said retracted position, and wherein a removable washing means is arranged inside said compartment for cleaning same.

29. An apparatus according to claim 28, wherein said removable washing means comprises a hollow perforated sphere provided with a plurality of liquid ejection orifices spaced therearound, said perforated sphere being disposed within said compartment, and a conduit connected to said perforated sphere for feeding a cleaning liquid thereto to cause said perforated sphere to direct jets of said cleaning liquid at predetermined locations inside said compartment, said conduit extending through said inlet opening and being removably mounted to said hopper underneath said hopper release gate.

30. An apparatus according to claim 1, wherein said liquid collection chamber is provided with a liquid outlet opening for discharging the liquid collected in said liquid collection chamber, said liquid outlet opening being connected to a liquid storage tank, and wherein a removable washing means is arranged inside said storage tank for cleaning same when said storage tank is empty.

* * * * *